US008028633B2

(12) United States Patent
Naka et al.

(10) Patent No.: US 8,028,633 B2
(45) Date of Patent: Oct. 4, 2011

(54) SEWING MACHINE CAPABLE OF EMBROIDERY SEWING

(75) Inventors: Takafumi Naka, Ama-gun (JP); Yasuhiro Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1109 days.

(21) Appl. No.: 11/711,765

(22) Filed: Feb. 28, 2007

(65) Prior Publication Data

US 2007/0204779 A1 Sep. 6, 2007

(30) Foreign Application Priority Data

Mar. 2, 2006 (JP) ..... 2006-055752

(51) Int. Cl.
*D05B 21/00* (2006.01)
*D05B 65/00* (2006.01)
*D05C 9/06* (2006.01)

(52) U.S. Cl. ..... 112/103; 112/470.18; 112/285

(58) Field of Classification Search ..... 112/470.03, 112/470.06, 470.09, 470.18, 103, 311, 285, 112/291–298; 38/102.91; 700/136–138
See application file for complete search history.

(56) References Cited

U.S. PATENT DOCUMENTS

| | | | | |
|---|---|---|---|---|
| 4,479,446 | A * | 10/1984 | Johnson et al. | 112/102.5 |
| 4,763,586 | A * | 8/1988 | Takenoya et al. | 112/470.06 |
| 5,138,960 | A * | 8/1992 | Inteso | 112/103 |
| 6,336,416 | B1 * | 1/2002 | French et al. | 112/103 |
| 6,725,795 | B2 * | 4/2004 | Gonzalez | 112/470.07 |
| 6,820,565 | B1 * | 11/2004 | Kawaguchi et al. | 112/102.5 |
| 7,258,071 | B2 * | 8/2007 | Shoji | 112/470.18 |
| 2008/0229988 | A1 * | 9/2008 | Kishi | 112/102.5 |
| 2010/0206204 | A1 * | 8/2010 | Shimizu et al. | 112/102.5 |

FOREIGN PATENT DOCUMENTS

| | | |
|---|---|---|
| JP | A 2-45089 | 2/1990 |
| JP | A-02-121691 | 5/1990 |
| JP | A-02-279195 | 11/1990 |
| JP | B2 3-35955 | 5/1991 |
| JP | A 7-16366 | 1/1995 |
| JP | A 8-252387 | 10/1996 |
| JP | B2 2770045 | 6/1998 |
| JP | A 11-76673 | 3/1999 |
| JP | B2 2909994 | 6/1999 |
| JP | A 2002-18166 | 1/2002 |
| JP | A-2002-052283 | 2/2002 |

OTHER PUBLICATIONS

Office Action issued in JP Application No. 2006-055752 on May 2, 2011 (with English translation).

* cited by examiner

*Primary Examiner* — Ismael Izaguirre
(74) *Attorney, Agent, or Firm* — Oliff & Berridge, PLC

(57) ABSTRACT

A sewing machine capable of embroidery sewing includes a plurality types of embroidery frames which hold a workpiece cloth; a carriage that has the embroidery frame detachably attached thereto by sliding the embroidery frame in a predetermined direction; a frame moving unit that moves the carriage in two directions intersecting in a horizontal plane; a control unit that controls the frame moving unit; a detection that detects a type of embroidery frame attached to the carriage; an operation instructing portion that allows a user to instruct movement of the embroidery frame to a predetermined position suitable for attachment/detachment of the embroidery frame, the operation instructing portion outputting a movement instructing signal to the control unit when operated; and a validating unit that validates operation of the operation instructing portion provided that an attachment of a specific type of embroidery frame is detected by the detection mechanism.

14 Claims, 16 Drawing Sheets

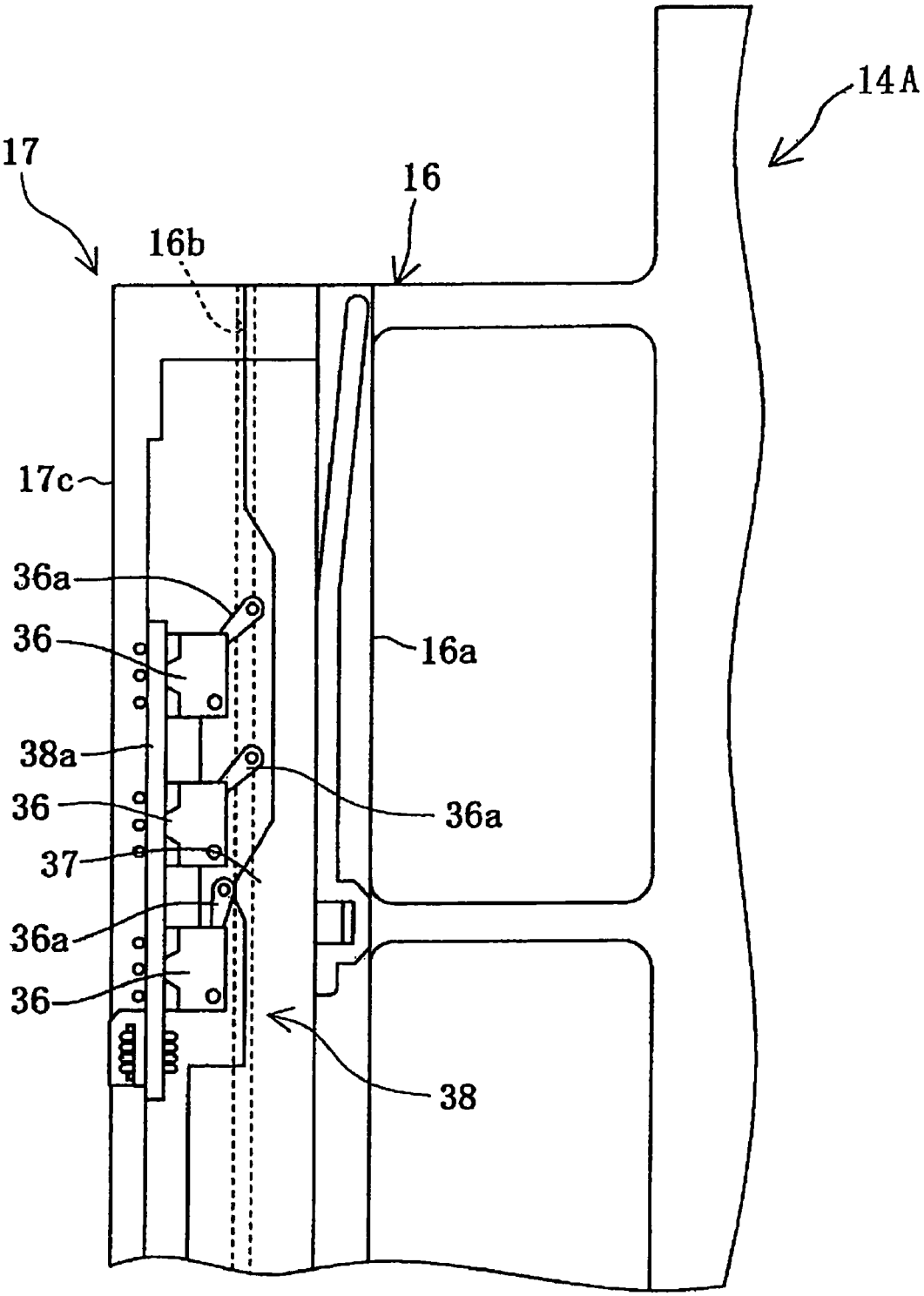
FIG. 4
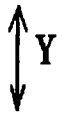

61a

| EMBROIDERY FRAME TYPE | FRAME-TYPE BASED SWITCH DATA |
|---|---|
| NOT ATTACHED | 0, 0, 0 |
| A | 0, 0, 1 |
| B | 0, 1, 0 |
| C | 0, 1, 1 |
| D | 1, 0, 0 |
| E | 1, 0, 1 |
| F | 1, 1, 0 |
| G | 1, 1, 1 |

FIG. 6

61b

| EMBROIDERY FRAME TYPE | SWITCH DATA | SPECIFIED DETACH POSITION | |
|---|---|---|---|
| | | X-COORDINATE | Y-COORDINATE |
| A | 0, 0, 1 | X1 | Y1 |
| E | 1, 0, 1 | X2 | Y2 |
| G | 1, 1, 1 | X3 | Y3 |

FIG.10

SEWING MACHINE CAPABLE OF EMBROIDERY SEWING

This application is based upon and claims the benefit of priority from the prior Japanese Patent Application 2006-055752, filed on, Mar. 2, 2006 the entire contents of which are incorporated herein by reference.

FIELD

The present disclosure is directed to a sewing machine capable of embroidery sewing which allows execution of sewing operation by attaching plurality types of interchangeable embroidery frames.

BACKGROUND

Sewing machines capable of embroidery sewing have been conventionally provided in the field of household sewing machine also. Such sewing machine capable of embroidery sewing generally includes, in its sewing machine body, a frame moving unit for moving an embroidery frame holding a workpiece cloth. The embroidery frame is provided with an inner frame and an outer frame and a workpiece cloth is clamped therebetween. The embroidery frame is detachably attached to the carriage of the frame moving mechanism by horizontally sliding the same in the longitudinal direction (from the front side to the rear side).

The sewing machine sews embroidery patterns on the workpiece cloth by moving the carriage having the embroidery frame attached thereto freely in the horizontal direction (X- and Y-directions) by the frame moving unit. The embroidery frames are interchangeable with frames of a plurality of types in various shapes and sizes such as round or rectangular shapes depending upon the size (shape) of the embroidery or the workpiece cloth.

Nowadays, a clamp-type embroidery frame provided with a lower frame and an upper frame for clamping the workpiece cloth therebetween and a clamp mechanism for retaining the workpiece cloth by pressing the upper frame against the lower frame have been suggested and reduced to practice to replace the conventional embroidery frame provided with the inner and outer frames which were of general use. For instance, Japanese Patent Application H08-252387 A (page 4, FIG. 3) discloses a clamp type embroidery frame provided with a base frame (lower frame) in frame-form; a presser frame (upper frame) clamping a workpiece cloth between the base frame; and a connecting member connecting the presser frame vertically swingably to the base frame; and a pair of left and right clamp mechanism unlockably pressure-locking the presser frame to the base frame.

Embroidery frames of general use provided with conventional inner and outer frames have been designed in relatively low vertical height (being generally thin). Thus, regardless of the position in which the embroidery frame (carriage) is stopped, the embroidery frame is allowed to pass through between the embroidery presser foot and the needle plate upper surface without interference, thereby allowing smooth attachment/detachment of the embroidery frame by being slid in the longitudinal direction. However, the above mentioned clamp-type embroidery frame, as compared with the aforementioned general embroidery frame, has greater vertical dimension at its clamp mechanism portion. Thus, as for the clamp-type embroidery frame, the attempt to attach/detach the embroidery frame at a given stopped position may cause the clamp mechanism portion to fail in passing through the space between the embroidery presser foot and the needle plate upper surface and consequently be damaged by colliding with the embroidery presser foot.

In this context, Japanese Patent Application 2002-18166 A (page 4, FIG. 2) discloses a compact sewing unit creating patches by mounting a cloth to a compact embroidery frame. The sewing unit is provided with a sewing unit body for sewing embroidery on a cloth; a safety cover for covering a sewing unit body; and an embroidery frame detachably attached to the sewing unit and a sewing cartridge equipped with a hollow sewing needle. Since the sewing unit is structured such that the sewing unit body is covered by the safety cover, the embroidery frame is arranged to be moved to a predetermined removing position (position situated outside the opening of the safety cover) for removing the embroidery frame after completion of embroidery sewing.

In the light of the above, a sewing machine provided with a clamp-type embroidery frame may also employ a configuration of moving the embroidery frame to a predetermined removing position (position in which the clamp mechanism does not interfere with the embroidery presser foot upon attachment and detachment of the embroidery frame). However, when the configuration of moving the embroidery frame to a predetermined removing position on a consistent basis after every completion of embroidery sewing is employed to a sewing machine capable of using both the embroidery frame of general use provided with inner and outer frames and the clamp-type embroidery frame, the following problem is encountered. That is, the generally used embroidery frame being detachable at any given position makes an unfruitful movement to the predetermined removing position, consequently reducing work efficiency.

SUMMARY

An object of the present disclosure is to provide a sewing machine capable of embroidery sewing which utilizes a plurality types of embroidery frames by detachably attaching the frames to the carriage, whereupon attachment/detachment of the embroidery frame, the embroidery frame and the embroidery presser foot can be kept from interfering with the other, thereby preventing reduction of work efficiency.

A first sewing machine capable of embroidery sewing in accordance with the present disclosure includes a carriage detachably holding a plurality types of embroidery frames by sliding the embroidery frames in attachment thereto in a predetermined direction; a frame moving unit moving the carriage in two directions intersecting in a horizontal plane; and a control unit controlling the frame moving unit; the sewing machine further including a detection mechanism detecting a type of embroidery frame attached to the carriage; an operation instructing portion outputting a signal instructing movement of the embroidery frame to a predetermined position suitable for attachment/detachment of the embroidery frame to the control unit; and a validating unit validating operation of the operation instructing portion provided that an attachment of a specific type of embroidery frame is detected by a detection mechanism.

Among the plurality types of embroidery frames, when the specific type of embroidery frame is attached to the carriage, operation of the operation instructing portion is validated by the validating unit based on the detection signal of the detection mechanism. When the validated operation instructing portion is operated, a movement instruction for moving the embroidery frame to a predetermined attachment/detachment position is inputted from the operation instructing portion to the control unit whereby the frame moving unit is moved and the embroidery frame is consequently moved to the predetermined attachment/detachment position. As opposed to this, when an embroidery frame other than the specific-type is attached to the carriage, the embroidery frame is not moved to the attachment/detachment position regardless of user operation of the operation instructing since the operation of the operation instructing portion is invalid.

Thus, by defining the embroidery frames subject to interference with the embroidery presser foot upon attachment/detachment as a specific type of embroidery frame, the embroidery frame can be prevented from interfering with the embroidery presser foot upon attachment/detachment by operating the operation instructing portion upon detachment of the embroidery frame from the carriage. Embroidery frames other than the specific-type, in other words, the type of embroidery frames which are not subject to interference, are not moved to the attachment/detachment position and are thus free from unfruitful movement, thereby preventing reduction of work efficiency.

In the present disclosure, the detection mechanism may be configured by a plurality of detection switches provided in the carriage and one or a plurality of switch activators formed in the embroidery frame in varying patterns for each type of embroidery frame. Thus, the type of embroidery frame can be reliably detected in a relatively simple mechanism.

The operation instructing portion can be configured by simply providing a transparent touch panel on the liquid crystal display for displaying sewing information without provision of mechanical switches. Under such configuration, the validating unit can be arranged to validate the operation of the operation instructing portion by displaying an operation key to the liquid crystal display. Such arrangement allows the user to readily verify the validity of the operation instructing portion.

In the present disclosure, the clamp-type embroidery frame provided with an upper frame and a lower frame vertically clamping the workpiece cloth and a clamp mechanism for pressing the upper frame against the lower frame may be defined as the specific type of embroidery frame. The clamp-type embroidery frame having greater height compared to embroidery frames of general use and being subject to interference with the embroidery presser foot can effectively avoid interference with the embroidery presser foot.

In case the clamp-type embroidery frame is employed as the specific-type embroidery frame, the position allowing the embroidery frame to pass through the space between the underside of the embroidery presser foot and the upper surface of the needle plate when the clamp-type embroidery frame is being moved in a detaching direction may be defined as the predetermined attachment/detachment position. Thus, interference between the clamp-type embroidery frame and the embroidery presser foot can be prevented reliably. Furthermore, the predetermined attachment/detachment position may be defined at a position where the clamp-type embroidery frame is moved to the front side of the sewing machine body, thereby allowing the user to attach/detach the embroidery frame with ease.

In the present disclosure, a thread cutting mechanism may be provided that cuts a needle thread extending downwardly from the eye of the sewing needle attached to the lower end of the needle bar and the bobbin thread at a position below the needle plate. In such case, when attachment of the specific type of embroidery frame to the carriage has been detected by the detection mechanism, the control unit may be configured to control the thread cutting mechanism to cut the needle thread and the bobbin thread after completion of embroidery sewing operation and thereafter control the frame moving unit to move the specific type of embroidery frame to the predetermined attachment/detachment position even in case the operation instruction portion has not been operated. Thus, the embroidery frame can be moved automatically to the predetermined attachment/detachment position after completion of embroidery sewing operation when the specific type of embroidery frame is attached to the carriage.

In the present disclosure, a position detector may be provided that detects the current position of the carriage or the embroidery frame. The validating unit may be configured to validate the operation of the operation instructing portion based on the position information provided by the position detector when attachment of the specific type of embroidery frame has been detected by the detection mechanism, provided that specific type of embroidery frame is not in the position suitable for attachment/detachment. As opposed to this, when the specific type of embroidery frame is already in a suitable position for attachment/detachment the embroidery frame is not moved to the predetermined attachment/detachment position, thereby preventing reduction of work efficiency more effectively.

A second sewing machine capable of embroidery sewing of the present disclosure includes a carriage detachably holding a plurality types of embroidery frames by sliding the embroidery frames in attachment thereto in a predetermined direction; a frame moving unit moving the carriage in two directions intersecting in a horizontal plane; and a control unit controlling the frame moving unit; the sewing machine further including a detection mechanism detecting a type of embroidery frame attached to the carriage; a thread cutting mechanism cutting a needle thread extending from an eye of a sewing needle attached to a lower end of a needle bar and a bobbin thread at a position below a needle plate; and the control unit controls the thread cutting mechanism to cut the needle thread and the bobbin thread after completion of embroidery sewing operation when attachment of specific type of embroidery frame to the carriage has been detected by the detection mechanism and thereafter controls the frame moving unit to move the specific type of embroidery frame to the predetermined attachment/detachment position.

Among the plurality types of embroidery frames, when the specified type of embroidery frame is attached to the carriage, the control unit cuts the needle thread and the bobbin thread by controlling the thread cutting mechanism after completion of embroidery sewing operation and automatically moves the embroidery frame to the predetermined attachment/detachment position by controlling the frame moving unit based on the detection signal of the detection mechanism. As opposed to this, when an embroidery frame other than the specific-type is attached to the carriage, the embroidery frame is not moved to the predetermined position after completion of embroidery sewing operation.

Thus, by defining the embroidery frame, having increased height for example, that interferes with the embroidery presser foot upon attachment/detachment thereof as the specific type of embroidery frame, the embroidery frame can be detached from the carriage at the predetermined attachment/detachment position where the interference of the embroidery frame and the embroidery presser foot can be prevented upon detachment of the embroidery frame. As for the embroidery frames other than the specific-type, in other words, the type of embroidery frames not subject to interference reduction of work efficiency can be restrained by eliminating unnecessary movement.

In the present disclosure, a position detector may be provided that detects the current position of the carriage or the embroidery frame. In such case, the control unit may be configured to move the specific type of embroidery frame to the predetermined attachment/detachment position based on the position information provided by the position detector when attachment of the specific type of embroidery frame to the carriage is detected by the detection mechanism provided that the specific type of embroidery frame is not in a suitable position for attachment/detachment.

The embroidery frame may be automatically moved to the predetermined attachment/detachment position when the specific type of embroidery frame is not in the position suitable of attachment/detachment of the embroidery frame. As opposed to this, when the specific type of embroidery frame is already in a position suitable for attachment/detachment, the specific type of embroidery frame is not moved to the predetermined attachment/detachment position, thereby preventing reduction of work efficiency more effectively.

In such case also, the clamp-type embroidery frame provided with an upper frame and a lower frame vertically clamping a workpiece cloth and a clamp mechanism for pressing the upper frame against the lower frame may be defined as the specific type of embroidery frame. The clamp-type embroidery frame having greater height compared to a general embroidery frame and being subject to interference with the embroidery presser foot can be prevented effectively from interfering with the embroidery presser foot.

In case the clamp-type embroidery frame is defined as the specified type of embroidery frame, a position allowing the embroidery frame to pass through the space between the under side of the embroidery presser foot and the upper surface of the needle plate when moving the clamp-type embroidery frame in a detaching direction may be defined as the predetermined attachment/detachment position. Thus, interference between the clamp-type embroidery frame and the embroidery presser foot can be prevented reliably. Furthermore, the predetermined attachment/detachment position may be defined in a position where the clamp type embroidery frame is moved to a position in the front side of the sewing machine body, thereby allowing the user to attach/detach the embroidery frame with better workability.

BRIEF DESCRIPTION OF THE DRAWINGS

Other objects, features and advantages of the present disclosure will become clear upon reviewing the following description of the illustrative aspects with reference to the accompanying drawings, in which, FIG. 1 indicates a first illustrative aspect of the present disclosure showing a perspective view of a sewing machine having a clamp-type embroidery frame attached thereto;

FIG. 4 is an enlarged plan view of a detection mechanism;

FIG. 6 shows a content of a specified switch data memory;

FIG. 10 shows a content of a specific-type embroidery frame memory;

DETAILED DESCRIPTION

A first embodiment applying the present disclosure to a household electronic sewing machine will be described with reference to FIGS. 1 to 14. Hereinafter, as shown in FIG. 1, description will be given on the sewing machine by defining the lateral direction of the sewing machine as the X-direction and the longitudinal direction as the Y-direction.

Figure 1:
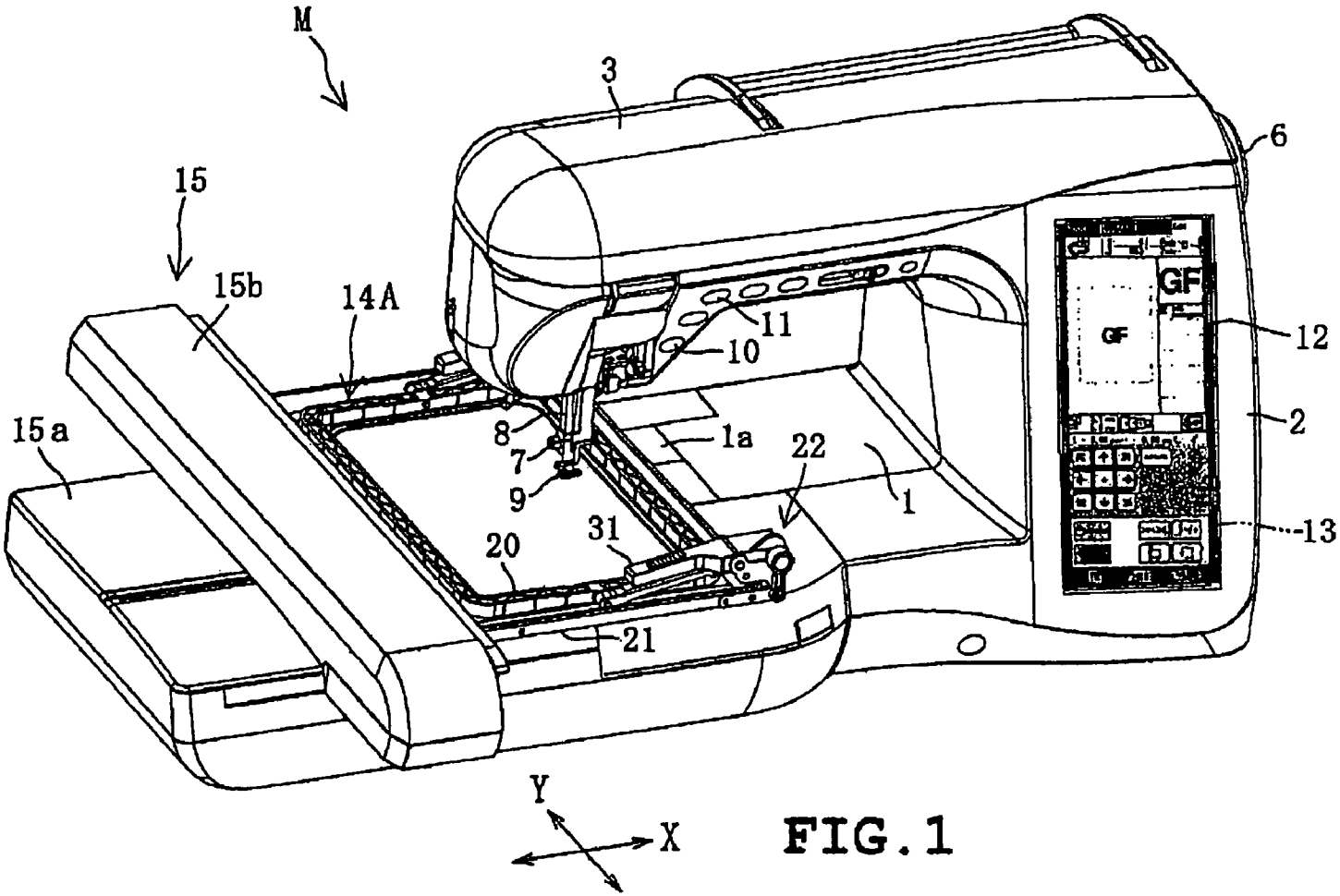

FIG. 1 illustrates an exterior view of a body of an electronic sewing machine M capable of embroidery sewing in accordance with the present embodiment. The body of the electronic sewing machine M is integrally provided with a laterally (X-direction) extending bed 1, a pillar 2 standing upward from the right end of the bed 1, and an arm 3 extending leftward from the upper end of the pillar 2.

Provided at the distal lower portion of the arm 3, is a needle bar (not shown) having a sewing needle 7. A needle plate la associated with the sewing needle 7 is provided on the upper surface of the bed 1. Provided inside the bed 1 in a position under the needle plate la are feed dog vertically-moving mechanism and feed dog longitudinally-moving mechanism (neither of which are shown) for vertically moving and longitudinally moving the feed dog 58 (refer to FIG. 7). Further, a horizontally rotating shuttle 4 (refer to FIG. 6) containing a bobbin 44 and forming stitches in cooperation with the sewing needle 7, a thread cutting mechanism 5 (refer to FIG. 7), and the like are provided inside the bed 1. The thread cutting mechanism 5, the details of which will be described afterwards, is for automatically cutting the bobbin thread and the needle thread downwardly extending from an eye of the sewing needle 7 at a position below the needle plate 1*a*.

Though not shown, a sewing machine main shaft rotationally driven by a sewing machine motor 72 (refer to FIG. 9) is provided inside the arm 3. A hand pulley 6 for manually rotating the sewing machine main shaft is provided at the right side surface of the arm 3. Though not shown, provided inside the arm 3 is a needle bar drive mechanism for vertically moving the needle bar and a needle bar swinging mechanism for swinging the needle bar in a direction (X-direction) perpendicular to the cloth feed direction and a thread take-up drive mechanism for vertically moving the thread take-up in synchronization with the vertical movement of the needle bar, and the like. The needle bar swinging mechanism is driven by a needle bar swinging step motor 73 (refer to FIG. 9).

In the distal lower portion of the arm 3, a presser bar 8 is positioned vertically movably to the rear of the sewing needle 7 (needle bar). The presser bar 8 is vertically moved between a raised position and a lowered position by a vertically-moving mechanism (not shown) driven by a presser bar vertically-moving step motor 74 (refer to FIG. 9). An embroidery presser foot 9 that press the workpiece cloth intermittently in synchronization with the needle bar is secured at the lower end of the presser bar 8 by screw fastening.

Provided in the front side of the arm 3 are various switches such as a start/stop switch 10 for instructing start and stop of the sewing procedure and thread cutting instruction switch 11. A large vertically-elongate liquid crystal display 12 capable of full color display is provided in the front face of the pillar 2. The liquid crystal display 12 displays various stitch patterns such as utility patterns and embroidery patterns; function names for executing various functions required for sewing work; and furthermore, various types of messages, and the like.

A touch panel 13 is provided at the front face of the liquid crystal display 12. The user is allowed to select embroidery patterns to be sewn, provide instructions for the intended function, and specify parameters by touching the touch panel 13.

A well known frame moving unit 15 is detachably attached to the left end of the bed 1. The frame moving unit 15 freely moves an embroidery frame 14 holding a workpiece cloth in two intersecting (perpendicular) directions in the horizontal plane over the sewing machine bed 1, the two directions being identified as an X-direction and a Y-direction.

The frame moving mechanism 15 is provided with a main body portion 15*a* at level with the upper surface (bed surface) of the bed 1 when attached thereto; and a drive portion 15*b* provided movably in the X-direction on the upper surface of the main body portion 15*a*. Provided in the side face of the drive portion 15*b* is a carriage 17 (refer to FIGS. 4 and 5) provided movably in the Y-direction. A connecting portion 16 of the embroidery frame 14 (refer to FIG. 2) is connected detachably to the carriage 17. Plurality types of embroidery frames 14 varying in size and shape etc. are selectively attached to the carriage 17.

Though not shown in detail, provided inside the main body portion 15*a* of the frame moving mechanism 15 is an X-direction drive mechanism composed of an X-direction drive motor 18 (refer to FIG. 9), and the like, for driving the drive portion 15*b* in the X-direction. Provided inside the drive portion 15*b* is a Y-direction drive mechanism composed of a Y-direction drive motor 19 (refer to FIG. 9) for driving the carriage 17 in the Y-direction, and the like.

When the frame moving unit 15 is attached to the bed 1, electrical connection is established with a control unit 77 of the electronic sewing machine M via a connector not shown. At this point, an embroidery sewing mode is set in alternative to a utility sewing mode and the control unit 77 controls the sewing machine motor 72, drive motors 18 and 19, and the like, based on embroidery data of the embroidery pattern to be sewn. Thus, the embroidery frame 14 is moved in the X- and Y-directions via the carriage 17 and embroidery sewing operation is automatically executed on the workpiece cloth held by the embroidery frame 14.

Next, a description will be given on the embroidery frame 14. The present embodiment employs plurality types of embroidery frames 14; seven for example, varying in shape, size and method of holding the workpiece (refer to FIG. 6). In case the types of embroidery frames need to be differentiated, A, B, C, D, E, F or G will be appended after the reference symbol 14 hereinafter. Further, the present embodiment identifies the three embroidery frames 14A, 14E, and 14G as the clamp-type embroidery frame and the remaining 14B, 14C, 14D and 14F as the conventional embroidery frame generally used which are provided with inner and outer frames.

The embroidery frame 14A is indicated in FIGS. 1, 2, 3, 4, 11A and 14 of the drawings to represent the clamp-type embroidery frame. Also, the embroidery frame 14B is indicated in FIG. 11B to represent the generally-used embroidery frame. The three clamp-type embroidery frames 14A, 14E, and 14G are identified as the specific types of embroidery frames. The configuration of the embroidery frames 14A and 14B will be described sequentially hereinafter.

Figure 2:
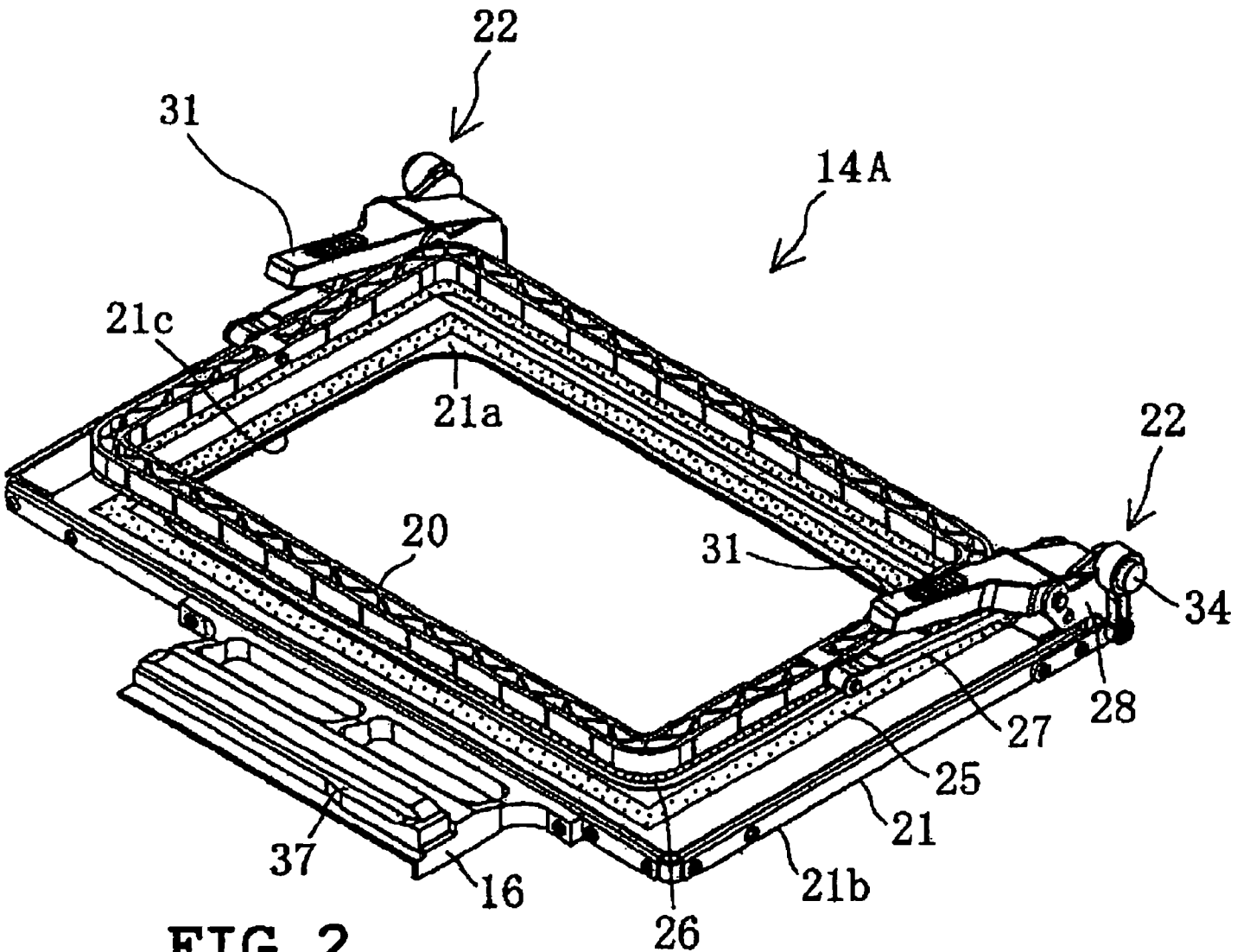
FIG. 2 is a perspective view of a clamp-type embroidery frame.

First, the clamp-type embroidery frame 14A will be described with reference to FIGS. 1 to 4, 11A, and 14A. The embroidery frame 14A, as shown in FIG. 2 for example, includes a lower frame 21, an upper frame 20 clamping a workpiece cloth between the lower frame 21, a pair of front and rear clamp mechanisms 22 and 22 for pressing the upper frame 20 against the lower frame 21. The clamp mechanisms 22 and 22 are configured to be longitudinally symmetrical.

The lower frame 21 is made of a metal plate, and is provided integrally with a rectangular retention plate 21*a* retaining the workpiece cloth from the underside; and a flanged wall 21*b* upwardly flanged at the outer periphery of the retention plate 21*a*. A large rectangular opening 21*c* is defined in the central portion of the retention plate 21*a* to allow execution of embroidery sewing. Also, a tape 25 made of silicon rubber for preventing slippage of the workpiece cloth is attached to the rectangular frame portion of the upper frame 20 confronting the upper surface of the retention plate 21.

A connecting portion 16 for establishing connection with the carriage 17 of the frame moving unit 15 is secured to the left side of the lower frame 21 as viewed in the drawings by screw fastening. Also, supports 28 for supporting the later described clamp mechanisms 22 and 22 are secured respectively at the right ends of the longitudinal sides of the lower frame 21. The connecting portion 16, as shown in FIG. 4, is provided with a longitudinally elongate engagement portion 16*b* at the lower end of a connection plate 16*a* extending in the longitudinal direction. As will be described later, a switch activator 37 is formed at the left side of the connecting portion 16 for each type of embroidery frame 14.

On the other hand, as shown in FIG. 2, the upper frame 20 is made of synthetic resin and is shaped in rectangular form so as to be mated (smaller than the flanged wall 21*b*) with the retention plate 21*a* of the lower frame 21. A foamed rubber sponge tape 26 is attached to the underside of the upper frame 20 for elastically pressing the workpiece cloth and preventing slippage thereof. The upper frame 20 is connected rotatably to each connecting member 27 and 27 of the pair of front and rear clamp mechanisms 22 and 22 described hereinafter and is mounted vertically swingably between a hold position (refer to FIGS. 1 and 14) holding the workpiece cloth against the lower frame 21 and the release position (refer to FIGS. 2 and 3) spaced upward from the lower frame 21.

Figure 3:
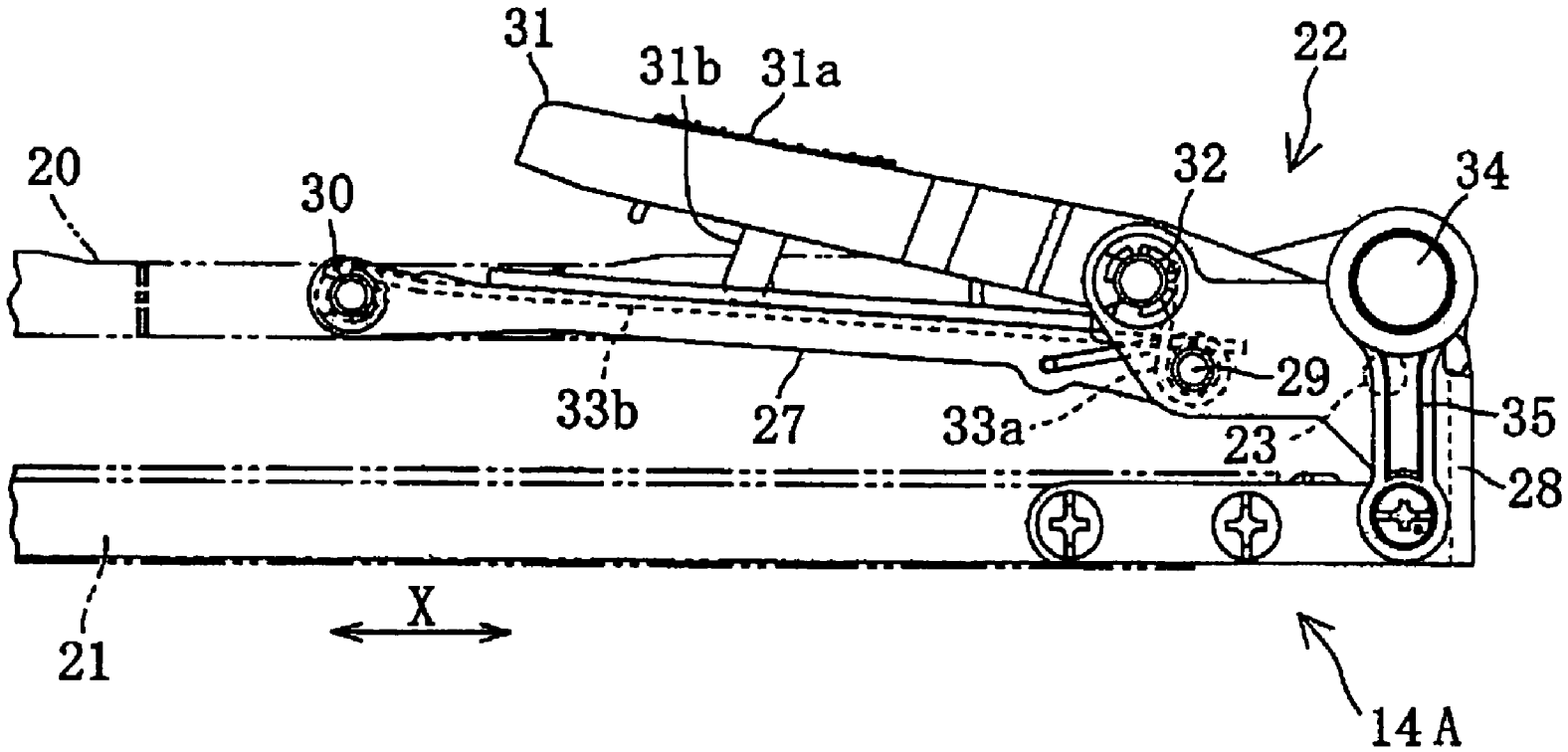
FIG. 3 is a partially enlarged front view of the clamp-type embroidery frame in an open position.

Next, the clamp mechanism 22 will be described with reference to FIG. 3 in the context of the front side clamp mechanism 22. As shown in FIGS. 2 and 3, the clamp mechanism 22 includes a connecting member 27 extending laterally along the front side of the upper frame 20, a lock mechanism (not shown) locking the upper frame 20 at a hold position holding down the workpiece cloth, and an unlock button 34 for canceling the locked state of the upper frame 20.

As shown in FIG. 3, the right end of the connecting member 27 is rotatably supported by the support 28 erected at the right end of the lower frame 21 via a support pin 29. The left end of the connecting member 27 is connected rotatably by a support pin 30 at the lateral mid-portion of the upper frame 20. Thus, the upper frame 20 is vertically moved in synchronization with the vertical swinging of the connecting member 27 about the support pin 29.

Also, a laterally extending operation lever 31 is supported rotatably to the support 28 by a support pin 32 at a position above the support 28. The operation lever 31 is provided with an operating portion 31*a* at the left end thereof and a downwardly projecting projection 31*b* is formed integrally to the underside of the operating portion 31*a*. The lateral mid-portion of the operation lever 31 is supported rotatably by the support pin 32 at a position higher than the support pin 29.

The connecting member 27 is biased clockwise as viewed in FIG. 3 by a releasing-bias spring 33*a* composed of a coil spring wound on the support pin 29. Thus, the connecting member 27, the operation lever 31 and the upper frame 20 are consistently biased in the upper position, in other words the release position.

Provided inside the connecting member 27 is a pressure bias spring 33*b* composed of an elongate plate spring material, the left end of which is wound in connection with the support pin 30 and the right end of which is fitted between the support pin 29 and the support pin 32. When the operating portion 31*a* of the operation lever 31 is manually rotated downward by the user, the mid-portion of the pressure bias spring 33*b* is elastically deformed by downward pressure exerted by the projection 31*b*, which elastic force moves the upper frame 20 to the hold position pressing the workpiece cloth against the lower frame 21. At this time, the right end of the operation lever 31 being locked by the later described lock mechanism retains the pressure of the upper frame 20 against the lower frame 21.

Though not shown in detail, the lock mechanism is configured as follows. A pin 23 biased in the forward direction by a compression spring (not shown) is attached at the right end proximity of the operation lever 31. When the operating portion 31*a* of the operation lever 31 is rotated by downward pressure, the pin 23 is engaged with the engagement hole (not shown) defined in the support 28 and locks the operation lever 31 unrotatably.

The unlock button 34 for canceling the lock is retained in inner fit with the upper end of the vertically elongate holder 35 secured by screw fastening to the support 28 and is biased so as to project forward by a compression spring (not shown). When the user presses the unlock button 34, the pin 23 is ejected from the engagement hole and the lock is cancelled. Then, the connecting member 27 and the operation lever 31 are raised by the spring force of the release bias spring 33*a* and the upper frame 20 is switched from the hold position pressing the workpiece cloth to the release position.

Next, referring to FIG. 11B, a description will be given on the configuration of the general embroidery frame 14B. The embroidery frame 14B, as well known, is provided with an inner frame 80 taking a substantially rectangular frame-form having round corners; an outer frame 81 disposed in the outer side of the inner frame 80, and a tightening mechanism 82 for tightening and loosening the outer frame 81 with respect to the inner frame 80. The workpiece cloth is held by being clamped between the outer periphery of the inner frame 80 and the inner periphery of the outer frame 81.

The outer frame 81 takes a rectangular frame-form having round corners capable of fitting to the outer side of the inner frame 80 and has a separated portion 81*a* at the front side thereof. Provided in the left side of the outer frame 81 is a connecting portion 16 secured by screw fastening for establishing connection with the carriage 17 of the frame moving unit 15 as described above. The connecting portion 16 has a switch activator 37 formed thereto.

The tightening mechanism 82 includes screw receptacles 83 and 84 provided respectively in the front portion of the left and right sections of the separated portion 81*a* of the outer frame 81; an adjustment screw 85 provided so as to connect the screw receptacles 83 and 84; and a operative tip 86, or the like, for operating the adjustment screw 85.

The workpiece cloth is placed so as to cover the upper surface of the inner frame 80 and the outer frame 81 with the adjustment screw 85 loosened (with the separating portion 81*a* spread) is placed over inner frame 80 so as to be fitted with the outer periphery thereof. Then, the operative tip 86 is operated to tighten the adjustment screw 85 and the workpiece cloth is retained in stretched state in the inner side of the inner frame 80 by tightening the outer frame 81 against the inner frame 80 so as to close the separating portion 81*a*. Upon removal of the workpiece cloth, the outer frame 81 can be removed from the inner frame 80 by loosening the adjustment screw 85 by operating the operative tip 86. The general embroidery frame 14B has a relatively small vertical height (being generally thin). As opposed to this, the clamp-type embroidery frame 14A has increased vertical size at its clamp mechanism 22 portion.

Figure 5:
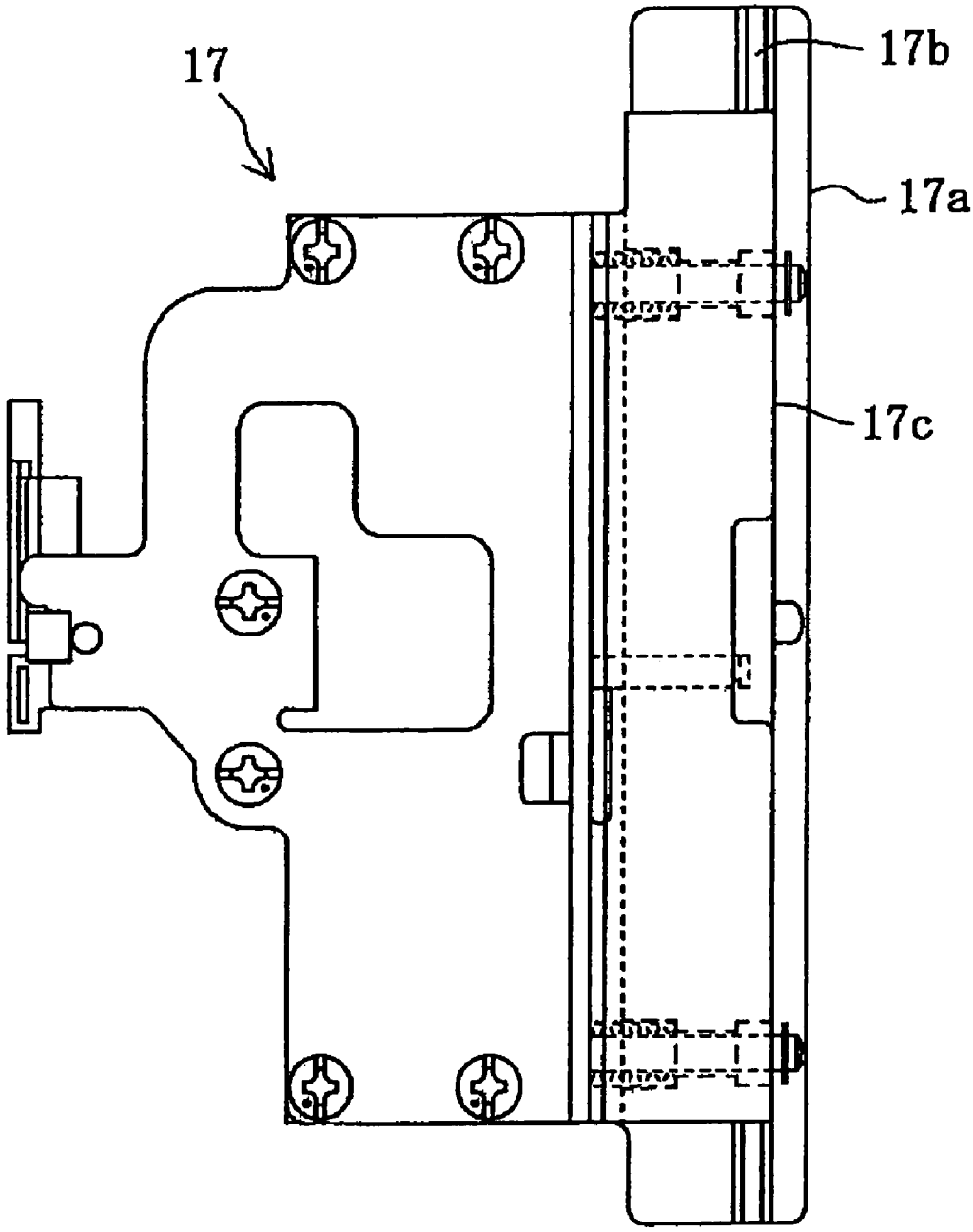
FIG. 5 is a plan view of the carriage.

The carriage 17 detachably receiving each embroidery frame 14 described above has a longitudinally extending engagement mechanism 17*a* in the right side thereof as shown in FIG. 5. The engagement mechanism 17*a* is arranged to establish disengagable engagement with the embroidery frame 14 by longitudinally sliding the connection plate 16*a* of the connecting portion 16 of the embroidery frame 14. More specifically, the engagement mechanism 17*a* has an engagement groove 17*b* allowing the engaging portion 16*b* of the connecting portion 16 to be slidably engaged therewith and a lock element 17*c* for locking the connecting portion 16 (embroidery frame 14) in an attached position (engaged state). The engagement mechanism 17*a* is arranged to only allow attachment and detachment of the embroidery frame 14 with respect to the carriage 17 from the front side.

As shown in FIG. 4, the carriage 17 (lock element 17*c*) has a detection mechanism 38 for detecting the type of embroidery frame 14 attached thereto. The detection mechanism 38 is configured by mounting a plurality of, three in this case, micro-switches composed of detection switches 36 in longitudinal alignment on the electronic substrate 38*a*.

On the other hand, the connecting portions 16 of each embroidery frame 14 is provided with a switch activator 37 for selectively turning the three detection switches 36 ON and OFF. More specifically, the switch activator 37 has concaves and convexes associated with the three detection switches 36 where the convexes act on an actuator 36*a* of the detection switch 36 and the concaves do not act on the actuator 36*a* of the detection switch 36. The switch activators 37 have specific combinations of convex-concave patterns that vary for each type of embroidery frame 14.

To give an example, the embroidery frame 14A has a switch activator 37 patterned such that one detection switch 36 in the near side is turned ON and the remaining two detection switches 36 are turned OFF. The embroidery frame 14B has a switch activator 37 patterned such that one detection switch 36 in the middle is turned ON and the remaining two detection switches 36 are turned OFF.

Detection signals delivered from each detection switch 36 is outputted to the control unit 77 of the sewing machine M via the electronic substrate 38*a*. As shown in FIG. 6, when the embroidery unit 14A is attached, the detection signal indicates "1, 0, 0" and when embroidery frame 14B is attached the detection signal indicates "0, 1, 0". A ROM 61 (refer to FIG. 9) of the control unit 77 is provided with a specified switch data memory 61*a* for storing frame-type based switch data for each type of embroidery frame 14 as shown in FIG. 6. The control unit 77 detects the type of embroidery frame 14 attached to the carriage 17 based on the frame-type based switch data and the detection signal outputted from the detection switch 36.

Figure 7:
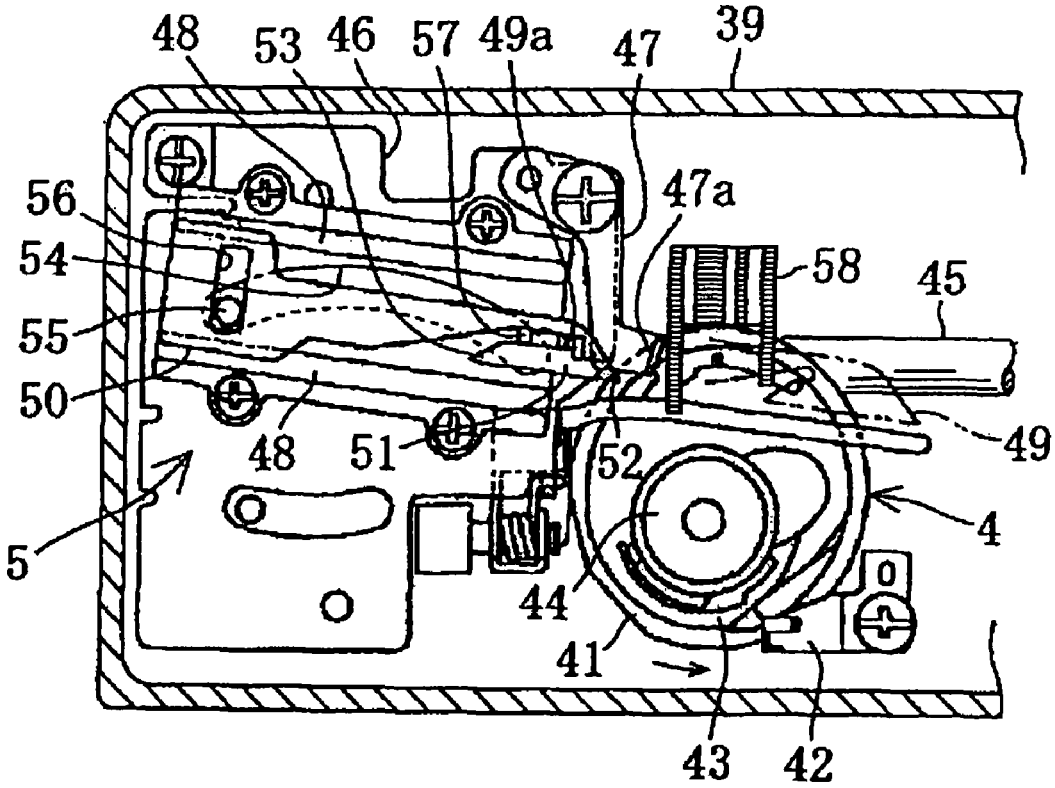
FIG. 7 is a transverse plan view showing a main portion of a thread cutting mechanism.
Figure 8:
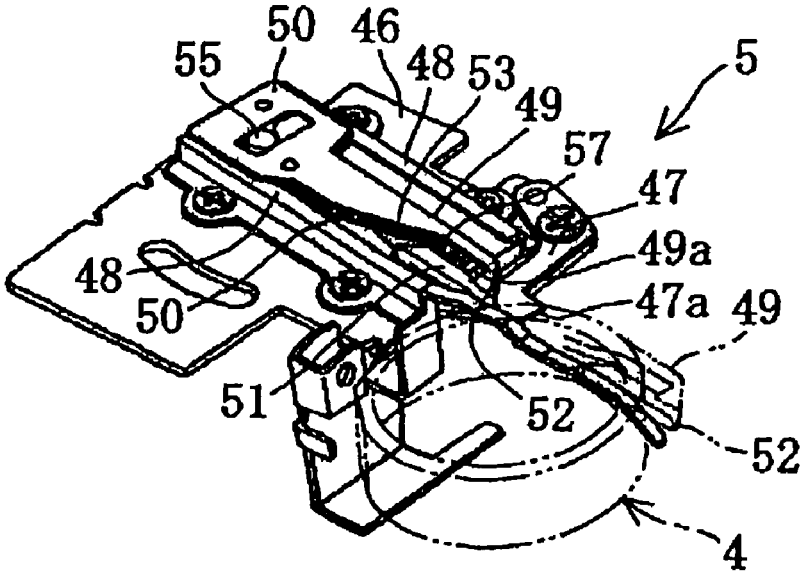
FIG. 8 is a partial perspective view of the thread cutting mechanism.

Next, a description will be given on the aforementioned thread cutting mechanism 5 with reference to FIGS. 7 and 8.

Provided in a machine frame 39 of the bed 1 is a horizontally rotating shuttle 4 situated below the needle plate 1*a*. The horizontally rotating shuttle 4 includes an outer shuttle 41 rotating about a vertical shaft line of the horizontally rotating shuttle 4; a middle shuttle 43 retained static inside the outer shuttle 41 by a shuttle stopper 42; a bobbin 44 accommodated rotatably inside the middle shuttle 43. A lower shaft 45 transmitting the rotary force of the sewing machine motor 72 (refer to FIG. 9) is provided inside the bed 1.

A static blade 47 having a blade portion 47*a* in close proximity of the horizontally rotating shuttle 4 is mounted on the rear upper surface of a support bracket 46. A pair of parallel guide rails 48 is laterally extended on the upper surface of the support bracket 46 and a movable blade 49 being guided by the guide rails 48 is provided reciprocably between a position indicated by solid line and a position indicated by double-dot chain line shown in FIGS. 7 and 8. The movable blade 49 is provided with a pair of plates 50 moving integrally above and below the static blade 47 and the distal ends of the two plates 50 are connected by a chip 51 made of synthetic resin.

The chip 51 has formed thereto a thread taker 52 that moves into a needle thread loop when the movable blade 49 advances rightward and a thread hook 53 for hooking the needle thread and the bobbin thread in the returning movement of the movable blade 49. A drawing portion 57 for securing remainder thread after cutting the needle thread and the bobbin thread is formed in the lower plate 50 at a portion further toward the distal end from the thread hook 53 and a blade portion 49*a* for cutting the needle thread and the bobbin thread by cooperation of the static blade 47 and the blade portion 47*a* is formed at corresponding portion of the upper plate 50.

A movable blade actuating lever (not shown) is disposed below the support bracket 46 and the front end of the movable blade actuating lever is supported rotatably thereto and the rear end of the movable blade operating lever is provided with a connection pin 55 projecting above the support bracket 46 by penetrating a circumferential escape through-hole 54 of the support bracket 46. The connection pin 55 is engaged with an elongate hole 56 defined at the base end of the movable blade 49.

A solenoid actuator 75 (refer to FIG. 9) for actuating the thread cutting mechanism 5 is provided inside the bed 1. When the solenoid actuator 75 is driven by the control unit 77 in accordance with a thread cutting instruction, the movable blade actuating lever is oscillated to the right and then to the left which single reciprocating cycle laterally reciprocates the movable blade 49 in synchronism to cut the needle thread and the bobbin thread.

Figure 9:
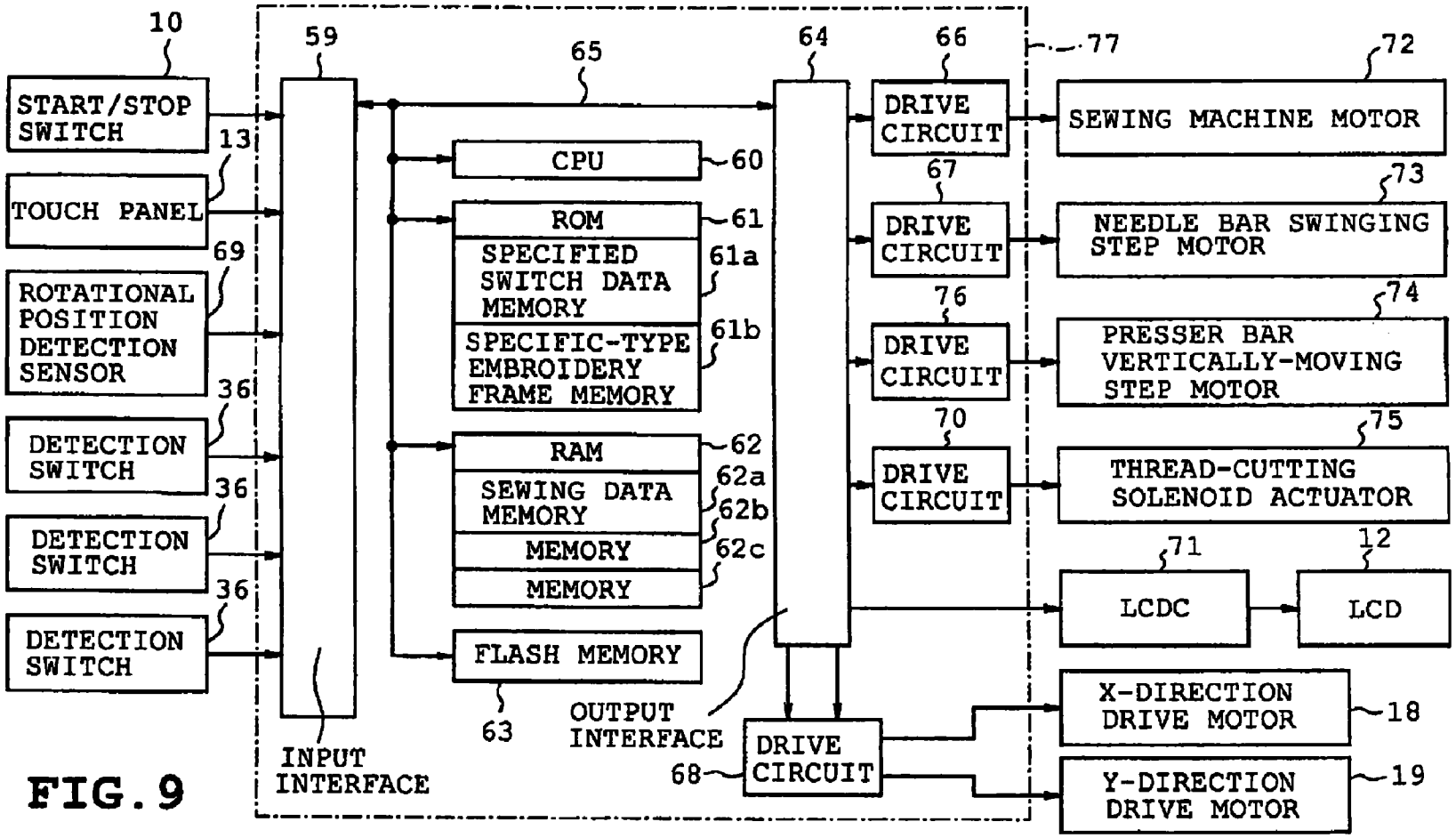
FIG. 9 is a schematic block view of electrical configuration of the sewing machine.

A description will be given on a control system of the above described electronic sewing machine M. FIG. 9 is a schematic indication of an electrical configuration primarily based on the control unit 77. The control unit 77 is mainly configured by a computer and includes a CPU 60, a ROM 61, RAM 62, programmable non-volatile flash memory 63, an input interface 59, an output interface 64, and a bus 65 mutually connecting the forgoing.

The input interface 59 has connected thereto a start/stop switch 10, a touch panel 13, rotational position detection sensor 69 for detecting the rotational position of the sewing machine main shaft, and three detection switches 36. Connected to the output interface 64 are drive circuits 66, 67 and 76 for driving motors 72, 73, and 74. The output interface 64 has further connected thereto a drive circuit 70 for a thread cutting solenoid actuator 75, a liquid crystal display controller (LCDC) 71 for a liquid crystal display (LCD) 12 and a drive circuit 68 for driving an X-direction drive motor 18 and a Y-direction drive motor 19 of the frame moving unit 15.

The ROM 61 is preinstalled with pattern data for a plurality of utility patterns required for normal sewing (utility sewing); embroidery pattern data for a plurality of embroidery patterns categorized under letter patterns and characters; a pattern selection control program for selecting utility patterns and embroidery patterns; embroidery sewing control programs for executing embroidery sewing, and an embroidery frame moving control program, and the like.

The ROM 61 is further provided with a specified switch data memory 61*a* and a specific-type embroidery frame memory 61*b*. As shown in FIG. 6, specified switch data memory 61*a* has pre-stored therein a frame-type based switch data that maps the types of the plurality types (7 types for example) of embroidery frames 14 being attached to the carriage 17 to the detection signals (switch data) of the three detection switches 36.

As shown in FIG. 10, the specific-type embroidery frame memory 61*b* has pre-stored therein data for the predetermined attaching/detaching position (specified detach position (Xi, Yi) (i=1, 2, 3)) suitable for detaching each clamp-type embroidery frames 14A, 14E and 14G when the embroidery frames 14A, 14E and 14G are attached to the carriage 17 and data group of detection signals (switch data) for three detection switches 36.

Figure 11A:
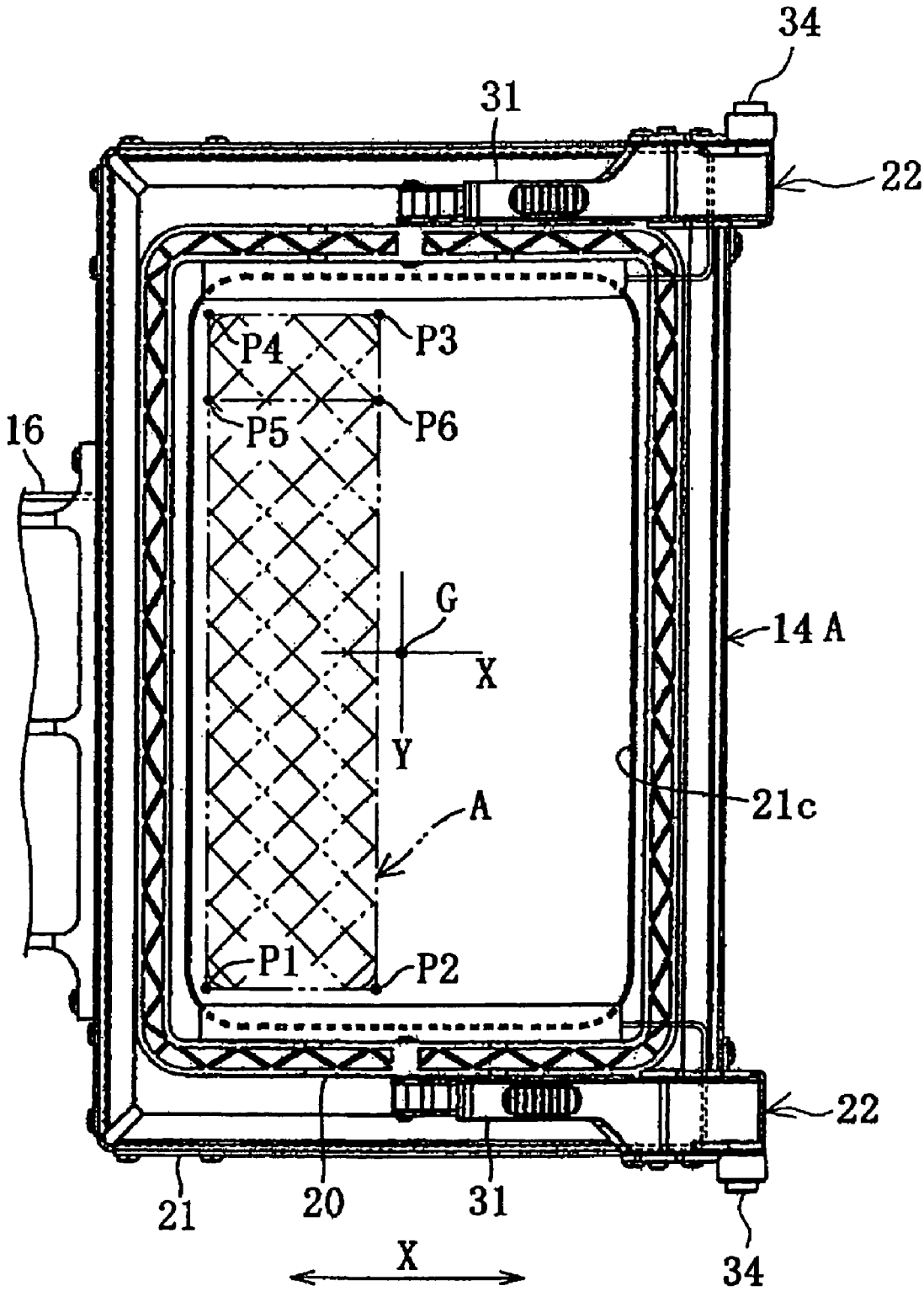
FIG. 11A is a plan view of the clamp-type embroidery frame and a removable area thereof.
Figure 11B:
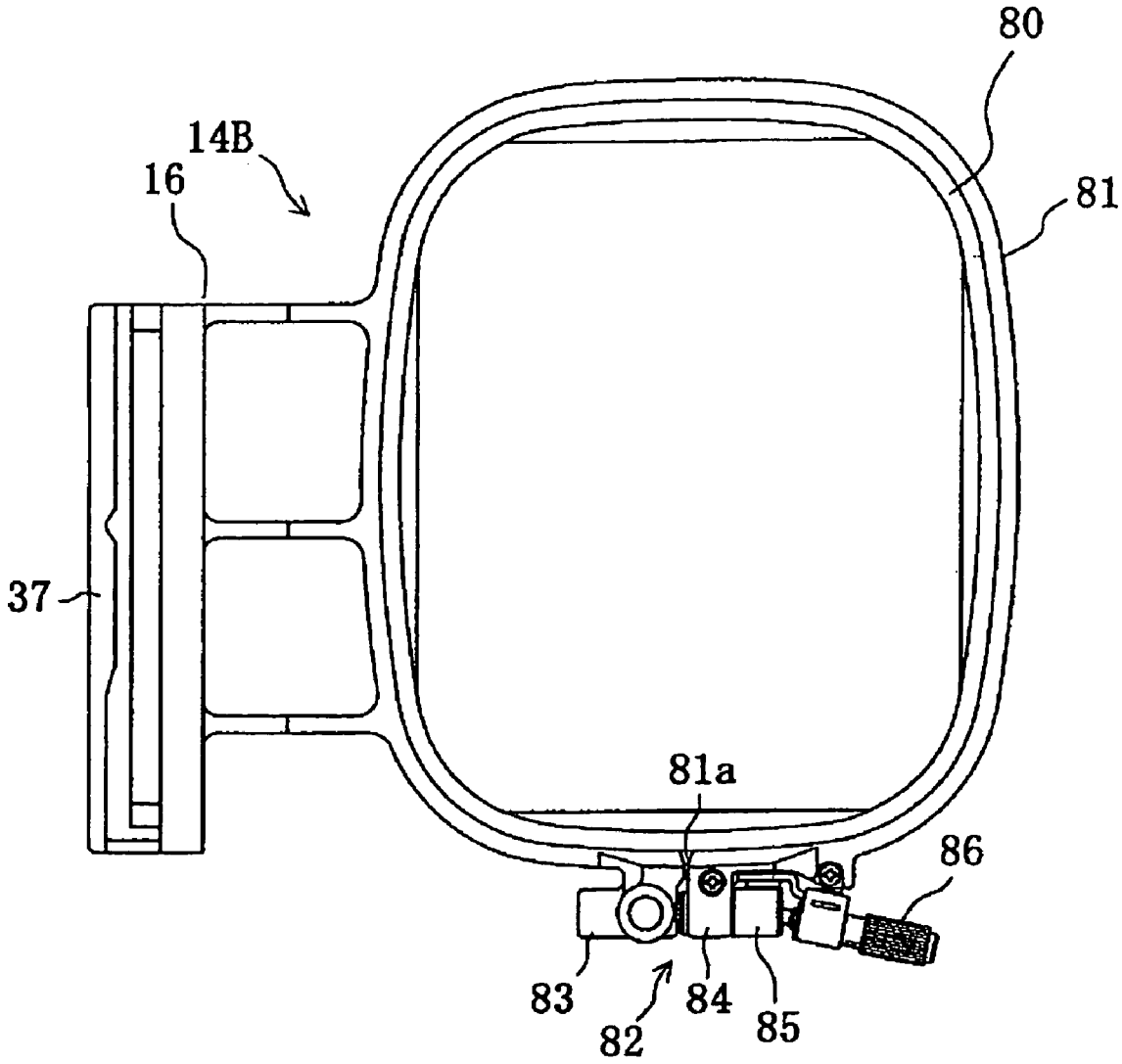
FIG. 11B is a plan view of a general embroidery frame.

In FIG. 11A, in the case of embroidery frame 14A for example, when the embroidery presser foot 9 is situated in a removable area A (within the range surrounded by dot P1, P2, P3 and P4) as shown in FIG. 11, the clamp mechanism 22 is not situated behind the embroidery presser foot 9, thereby allowing the embroidery frame 14A to pass between the underside of the embroidery presser foot 9 and the upper surface of the needle plate 1*a*. The operation lever 31 of the clamp mechanism 22 does not interfere with the embroidery presser foot 9 even if the embroidery frame 14 is slid forward from the carriage 17 upon detachment of the embroidery frame 14A. Also, the embroidery frames 14 of type E and G are each specified with their own detachable area A allowing the embroidery frame 14 to pass through between the underside of the embroidery presser foot 9 and the upper surface of the needle plate 1*a*.

Figure 14:
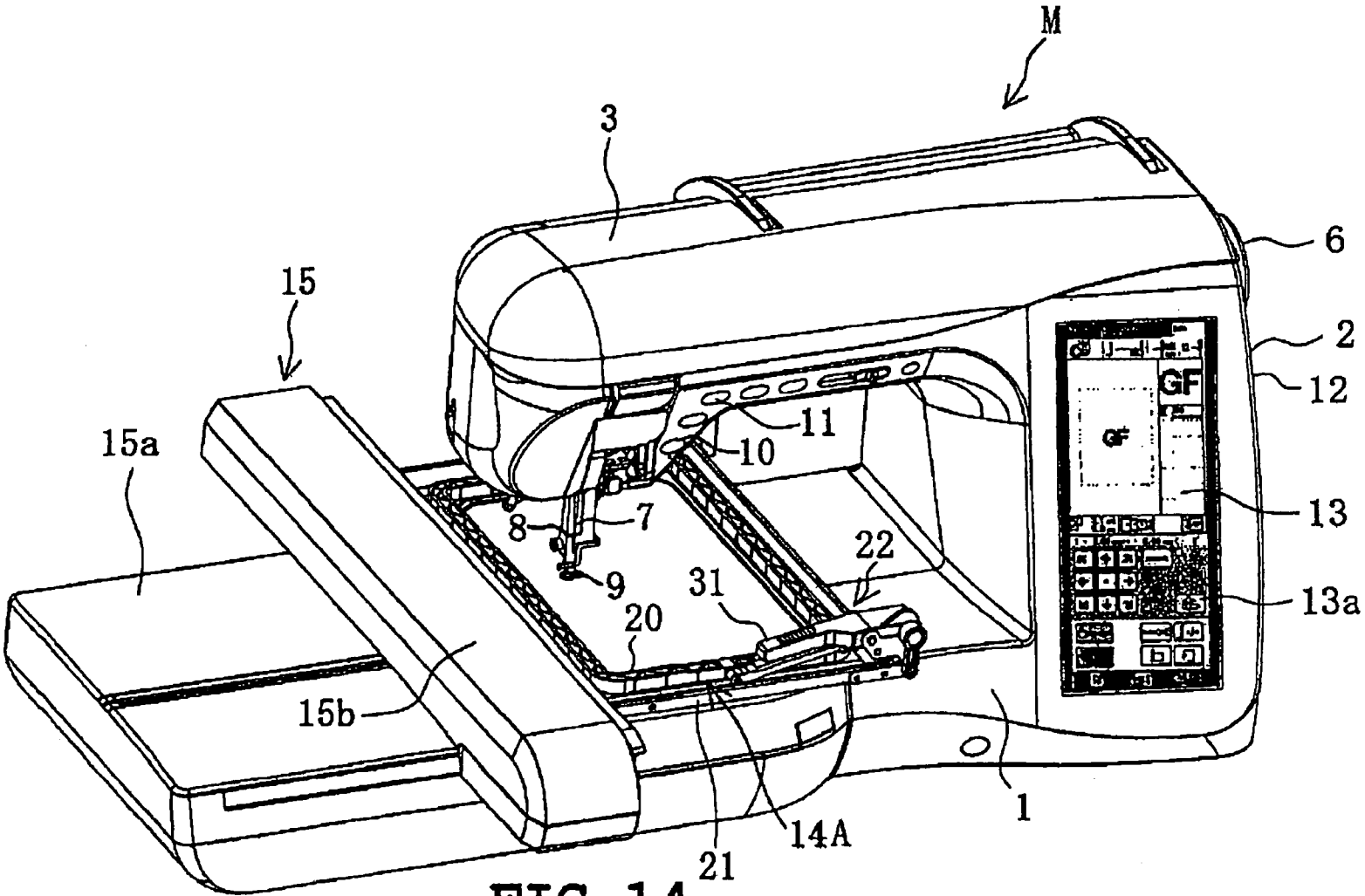
FIG. 14 is a perspective view of the sewing machine when the embroidery frame is moved to an attachment/detachment position.

Therefore, Xi of specified detach position (Xi, Yi) is set at a given value within the range of X-coordinate value of dot P1 (or P4) to X-coordinate value of dot P2 (or P3). Yi of specified detached position (Xi, Yi) is set at a given value within the range of Y-coordinate value of P1 (or P2) to Y-coordinate value of P3 (or P4). FIG. 14 indicates the embroidery frame 14A being moved to the specified detached position.

However, since detaching the embroidery frame 14 after being moved to the proximity of the user (front side) provides better workability, it is preferable to specify Yi of the specified detach position (Xi, Yi) at a given value between the Y-coordinate value of dot P5 (or P6) to Y-coordinate value of dot P3 (or P4). Dots P5 and P6 are dots specified forward relative to dots P4 and P3.

Origin G of the coordinates is a position in which a needle bar shaft center is located at the center of an opening 21*c* inclusive of the embroiderable area. Also, the above described general embroidery frames 14B, 14C, 14D, and 14F have thickness such that each frame in its entirety is capable of passing between the underside of the embroidery presser foot 9 and the upper surface of the needle plate 1*a*. Thus, the embroidery frames 14B, 14C, 14D, and 14F when detached (when slid to the front side) do not interfere with the embroidery presser foot 9 regardless of where the embroidery frames are stopped.

As shown in FIG. 9, the RAM 62 is provided with a sewing data memory 62*a* for storing embroidery pattern data of embroidery patterns read from the ROM 61 to be used for execution of embroidery sewing; a memory 62*b* storing detection signals read from the detection switch 36; a memory 62*c* storing data read from specific-type embroidery frame memory 61*b*; and various work memory.

Figure 13:
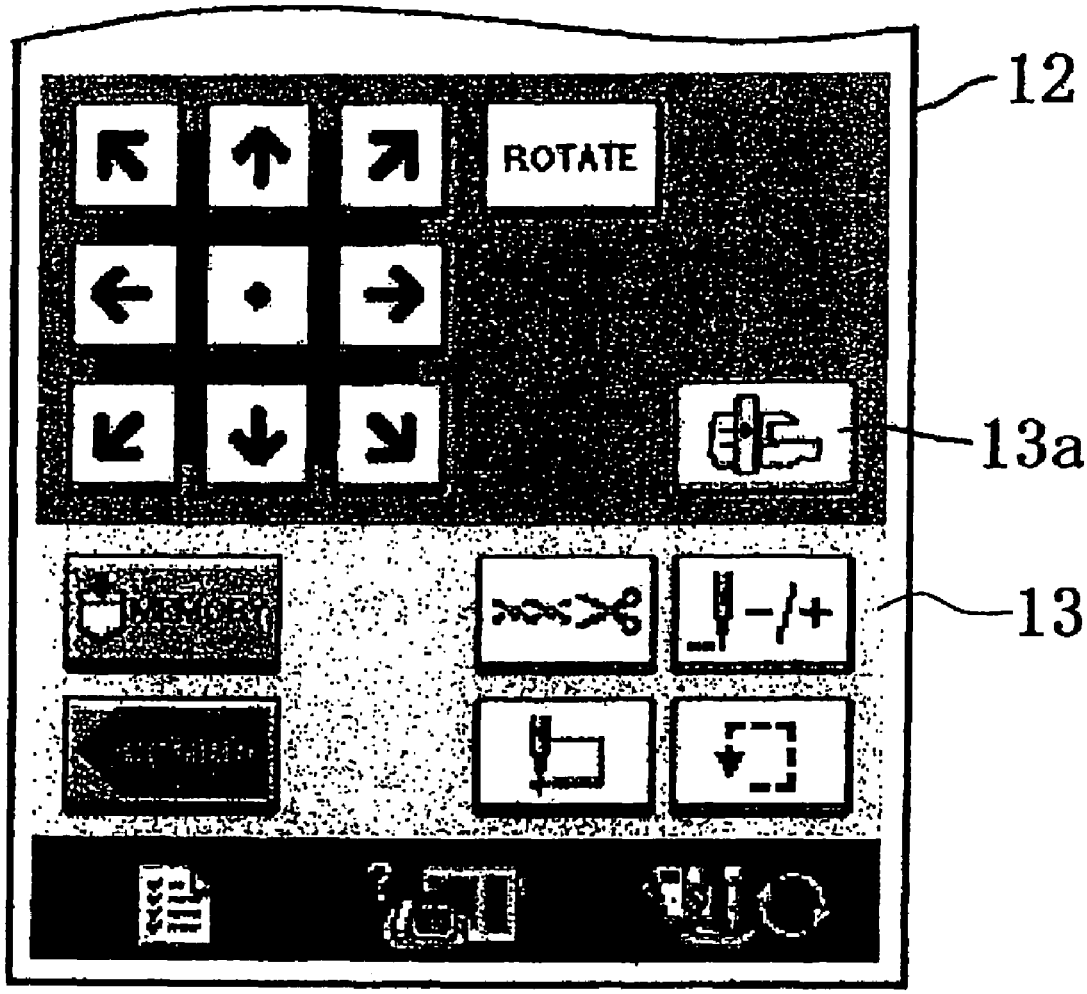
FIG. 13 is a front view showing an example of a detach key being displayed to the display.

When it has been detected that a specific embroidery frame 14 (embroidery frames 14A, 14E, and 14G) is attached to the carriage 17 by the detection mechanism 38 (three detection switches 36), the control unit 77, as shown in FIG. 13 displays an icon indicative of a detach key on the screen of the liquid crystal display 13 and sets a detach key 13*a* on the touch panel 13. The detach key 13*a* instructs movement of the specific embroidery frame 14 to the specified detach position. After completion of embroidery sewing operation, when the user touches the detach key 13*a*, the control unit 77 controls the frame moving unit 15 so as to move the embroidery frame 14 to the predetermined specified detach position (Xi, Yi) stored in the specific-type embroidery frame memory 61*b*.

As opposed this, when the detection mechanism 38 has detected other types of embroidery frames 14 (embroidery frame 14B, 14C, 14D and 14F), the control unit 77 does not set the detach key 13*a*. Thus, the control unit 77 functions to validate the operation of the detach key 13*a* provided that attachment of the specific type of embroidery frame 14 to the carriage 17 has been detected by the detection mechanism 38.

Figure 12:
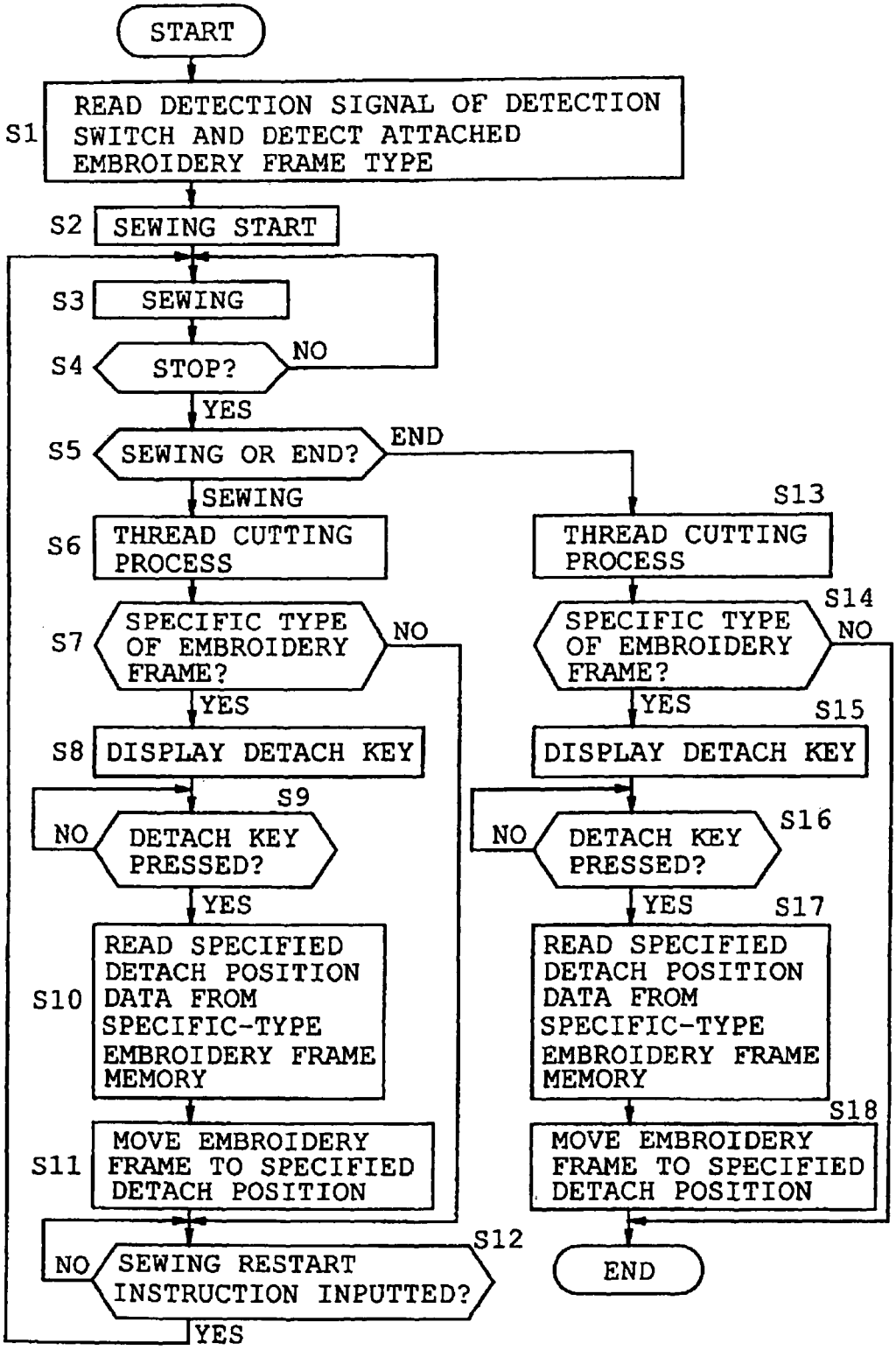
FIG. 12 is a flowchart indicating process flow for an embroidery frame moving control.

Next, the operation of the above described configuration will be described with reference to FIG. 12. The flowchart in FIG. 12 indicates the process sequence of the embroidery frame moving control executed by the control unit 77. It is to be noted that reference symbols Si (i=1, 2, . . . ) indicate each step.

When power is supplied to the sewing machine M, the embroidery frame moving control is started. After execution of required initial settings and reading of various signals, detection signals of the three detection switches 36 are read in step S1. The type of embroidery frame 14 attached to the carriage 17 is detected by comparing the detection signal (switch data group) with the specified switch data memory 61*a* of the frame-type based switch data. The switch data group is stored in the memory 62*b* of the RAM 62.

Thereafter, embroidery sewing is started (step S2) after selecting the embroidery pattern to be sewn, reading the embroidery pattern data, and other related processes. In step S3, sewing operation is continued and thereafter in step S4, judgment is made whether sewing operation has been stopped or not and if not stopped (No in step S4), process returns to step S3. If sewing operation is stopped (Yes in step S4), judgment is made whether sewing operation is ongoing or stopped in step S5. In case sewing is stopped for reasons such as replacement of the bobbin 44, the solenoid actuator 75 for thread cutting is driven in response to the operation of the thread cut setting switch 11 in step S6 and thread cutting process for cutting the needle thread and the bobbin thread is executed by the thread cutting mechanism 5.

Next, in step S7, judgment is made whether the embroidery frame 14 detected in step S1 is a specific type of embroidery frame 14 or not. This judgment is made by searching whether or not the switch data group detected in step S1 is stored in the specific-type embroidery frame memory 61*b*.

The process proceeds to step S8 if it has been judged that the embroidery frame 14 is of a specific-type, and to step S12 if not. Next, the detach key 13*a* is displayed (step S8) to the liquid crystal display 12 as shown in FIG. 13. When the detach key 13*a* is touched (Yes in step S9), specified detach position data (Xi, Yi) associated with the corresponding embroidery frame 14 is read from the specific-type embroidery frame memory 61*b* and stored in the memory 62*c* of the RAM 62 (step S10). Subsequently, in step S11, the carriage 17 is moved based on the specified detach position data and the embroidery frame 14 is moved to the specified detach position. Thereafter, upon input of a sewing restart instruction, the process proceeds to step S3.

Thus, when the embroidery frame 14 is moved to the specified detach position (refer to FIG. 14), the embroidery presser foot 9 enters the detachable area A shown in FIG. 11A, thereby allowing the user to detach the embroidery frame 14 from the carriage 17 by sliding the embroidery frame 14 forward. In doing so, the embroidery frame 14 does not interfere with the embroidery presser foot 9.

If it has been judged that sewing operation has been completed in step S5, the process proceeds to step S13 and the process is terminated after executing steps S13 to S18 similar to steps S6 to S11. As a result of the judgment in step S14, if the embroidery frame 14 is not a specific-type, process is terminated without execution of steps S15 to S18.

Thus, even in case embroidery sewing operation has been completed, since the embroidery frame 14 is moved to the specified detach position by the operation of the detach key 13*a* only when the embroidery frame 14 is of a specific-type, the embroidery frame 14 can be detached from the carriage 17 without interfering with the embroidery presser foot 9.

The present embodiment as described above provides the following effects. Among the plurality types of embroidery frames 14, when the specific-type embroidery frame 14, more specifically, the embroidery frame 14 having increased height at a portion thereof and being subject to interference with the embroidery presser foot 9 upon detachment thereof is attached to the carriage 17, the detach key 13*a* is set (validated) on the touch panel 13. Thus, the user is allowed to automatically move the embroidery frame 14 to the specified detach position by operating the detach key 13*a*.

Therefore, upon detachment of the specific-type embroidery frame 14 from the carriage 17, interference between the embroidery frame 14 and the embroidery presser foot 9 can be prevented by merely operating the detach key 13*a*. When a non-specific-type embroidery frame 14, more specifically, an embroidery frame 14 not subject to interference is attached, since embroidery frame 14 is not moved, reduction of work efficiency can be restrained by eliminating unnecessary movement. In this case, since the detach key 13*a* itself will not be set, erroneous (undesired) user operation of the detach key 13*a* can be prevented.

Partial modifications of the above described embroidery frame moving control will be described by way of examples.

Figure 15:
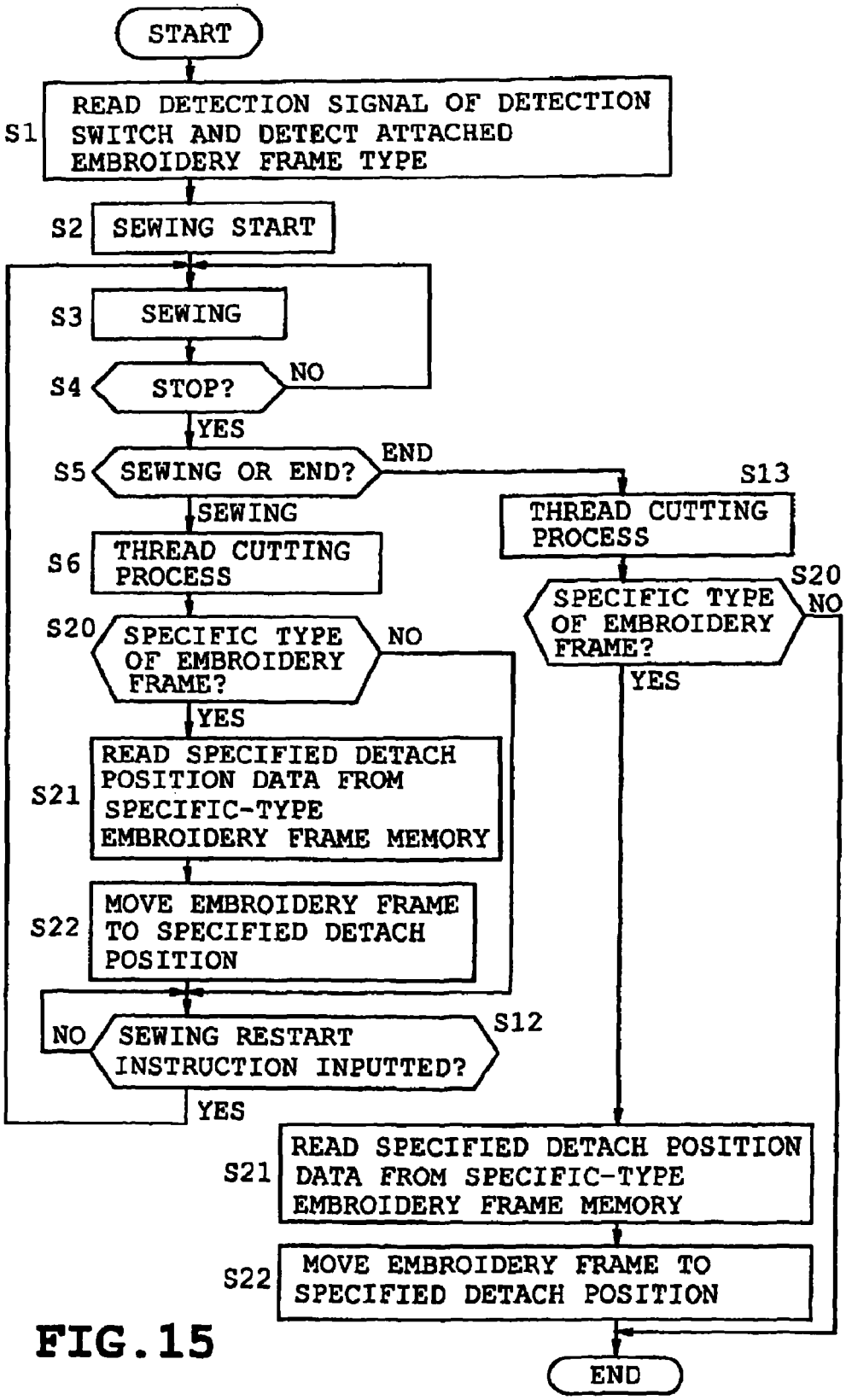
FIG. 15 corresponds to FIG. 12 and indicates a second illustrative aspect of the present disclosure.

1] The flowchart in FIG. 15 indicates a second embodiment of the present disclosure and varies from the first embodiment in the following respects. The control unit 77 of the present embodiment does not set the detach key 13*a* to the touch panel 13. Instead, upon completion (and tentative stop) of embroidery sewing operation, the control unit 77 automatically moves the embroidery frame 14 to the specified detach position on a consistent basis after execution of thread cutting operation by the thread cutting mechanism 5 when the detection mechanism 38 has detected the attachment of the specific type of embroidery frame 14 to the carriage 17.

More specifically, in case sewing operation is tentatively stopped in step S5, judgment is made whether or not the attached embroidery frame 14 is a specific type of embroidery frame 14 in step S20. In case the embroidery frame 14 is judged as a specific type of embroidery frame 14 (Yes in step S20), specified detach position data is read from the specific-type embroidery frame memory 61*b* in step S21, and thereafter the embroidery frame 14 is moved to the specified detach position in step 522. In case a No judgment is made in step S20, the process is subsequently terminated. Also, in case it has been judged that sewing operation has been completed in step S5, series of processes similar to steps S20 to 22 are executed.

According to such configuration, in case a specific type of embroidery frame 14 is attached, since thread cutting operation is executed after completion of sewing operation and the embroidery frame 14 is automatically moved to the specified detach position, the specific-type embroidery frame 14 can be detached more efficiently, without having to input instructions to move the embroidery frame 14.

Figure 16:
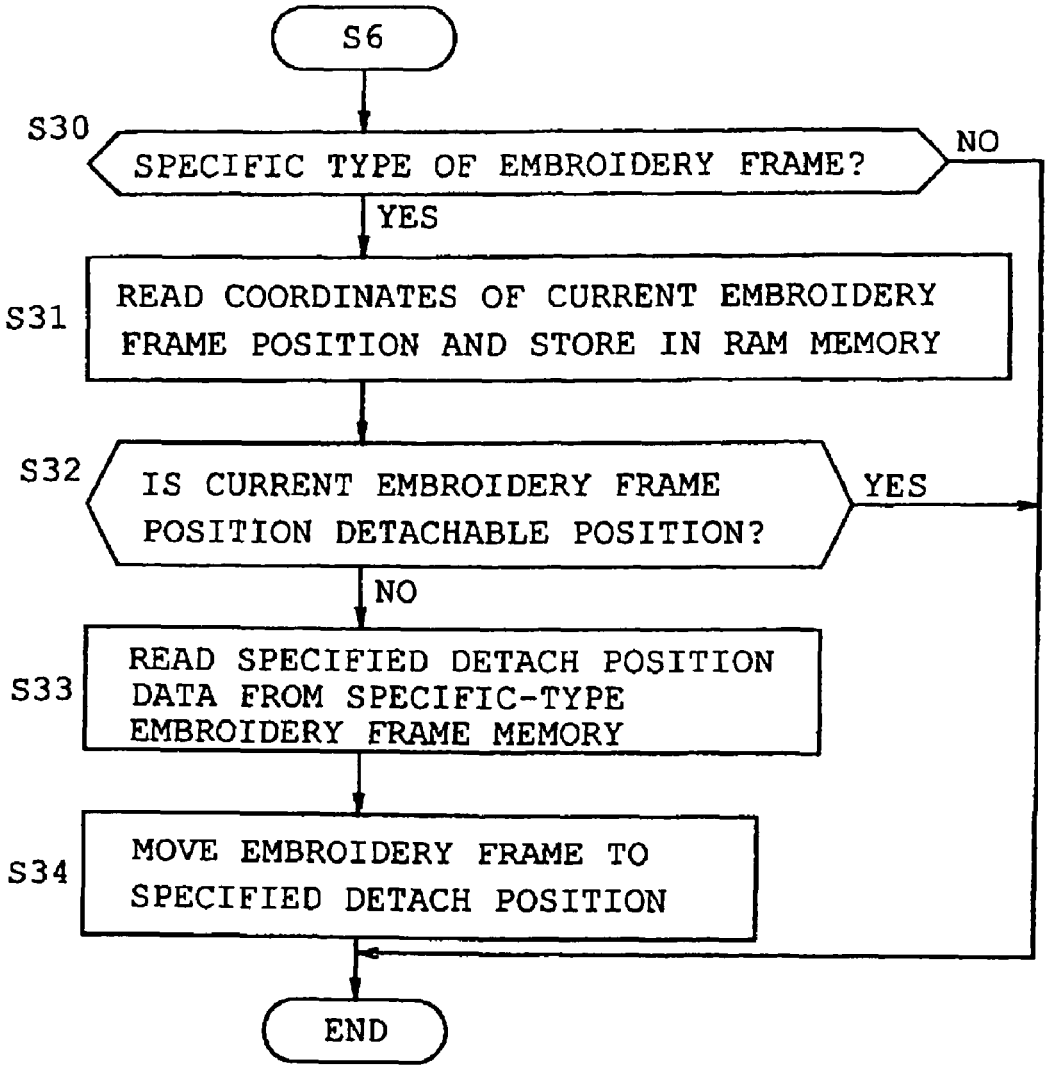
FIG. 16 indicates a third illustrative aspect of the present disclosure showing a main portion of a flowchart indicating process flow for the embroidery frame moving control.

2] FIG. 16 indicates a third embodiment of the present disclosure. In the third embodiment, steps S7 to S11 and S14 to S18 of the flowchart in FIG. 12 of the first embodiment is modified as shown in steps S30 to S34 of FIG. 16. However, when such embroidery frame moving control is employed, a current position memory that is updated with the current position (current position of the carriage 17) of the embroidery frame 14 during the sewing operation is provided in the RAM 62 of the control unit 77.

In step S5 of the flowchart in FIG. 16, when sewing operation is tentatively stopped and when embroidery sewing operation is completed, a judgment is made whether or not the attached embroidery frame 14 is a specific type of embroidery frame in step S30 and when a Yes judgment is made, coordinates of the current position of the embroidery frame 14 is read from the current position memory of the embroidery sewing control and stored into the memory in the RAM 62 in step S31.

Next, a judgment is made whether or not the coordinates of the current position of the embroidery frame 14 is within the detachable area A (area surrounded by dot P1, P2, P3, and P4) in FIG. 11A. In case a No judgment is made, specified detach position data is read from the specific-type embroidery frame memory 61*b* in step S33 and thereafter the embroidery frame 14 is moved to the specified detach position in step S34. In case a Yes judgment is made in step S32, since the embroidery frame 14 is in the detachable area, the embroidery frame can be detached without moving the embroidery frame, thus the process proceeds to step S12, or is terminated.

In this control, the embroidery frame 14 is automatically moved to the specified detach position when the embroidery frame 14 is not in the detachable area without displaying the detach key 13*a*. Thus, the embroidery frame 14 is automatically moved to the specified detach position without having to input any movement instructions, thereby allowing more efficient detachment of the embroidery frame 14. Also, when no interference is expected upon detachment of the embroidery frame 14, unnecessary movement of the embroidery frame 14 can be eliminated.

3] The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims. For example, though not shown, the detach key 13*a* may be displayed (set) consistently regardless of the type of the embroidery frame 14, and the operation of the detach key 13*a* may be validated only when the specific-type embroidery frame 14 is detected by the detection mechanism 28 and prevent movement of the embroidery frame even if the detach key 13*a* is operated when other types of embroidery frames 14 are attached. In this case, a mechanical switch may be applied as the operation instructing portion. Also, the detection mechanism 38 may be configured by an optical sensor, magnetic sensor, or the like.

What is claimed is:

1. A sewing machine capable of embroidery sewing comprising:

a plurality types of embroidery frames which hold a workpiece cloth;

a carriage that has an embroidery frame of the plurality of types of embroidery frames detachably attached thereto by sliding the embroidery frame in a predetermined direction;

a frame moving unit that moves the carriage in two directions intersecting in a horizontal plane;

a control unit that controls the frame moving unit;

a detection mechanism that detects a type of embroidery frame attached to the carriage;

an operation instructing member that allows a user to instruct the control unit to control the frame moving unit to move the embroidery frame to a predetermined position suitable for attachment/detachment of the embroidery frame, the operation instructing member outputting a movement instruction signal to the control unit when operated; and a validating unit that validates operation of the operation instructing member provided that attachment of a specific type of embroidery frame is detected by the detection mechanism.

2. The sewing machine of claim 1, wherein the detection mechanism includes a plurality of detection switches provided in the carriage, and one or a plurality of switch activators formed in the embroidery frame in varying patterns for each type of embroidery frame.

3. The sewing machine of claim 1, wherein the operation instructing member is composed of a transparent touch panel provided on a liquid crystal display surface for displaying sewing information.

4. The sewing machine of claim 3, wherein the validating unit validates operation of the operation instructing member by displaying an operation key to the liquid crystal display.

5. The sewing machine of claim 1, wherein the specific type of embroidery frame is a clamp-type embroidery frame provided with an upper frame and a lower frame vertically clamping a workpiece cloth and a clamp mechanism that presses the upper frame against the lower frame.

6. The sewing machine of claim 5, wherein the predetermined attachment/detachment position is a position allowing the clamp-type embroidery frame to pass through a space between an underside of an embroidery presser foot and a needle plate upper surface when moving the clamp-type embroidery frame in a detaching direction.

7. The sewing machine of claim 6, wherein the predetermined attachment/detachment position is a position where the clamp-type embroidery frame is moved to a front side of a sewing machine body.

8. The sewing machine of claim 1, further comprising a thread cutting mechanism that cuts a needle thread extending from an eye of a sewing needle attached to a lower end of a needle bar and a bobbin thread at a position below a needle plate, wherein when attachment of the specific type of embroidery frame to the carriage has been detected by the detection mechanism, the control unit controls the thread cutting mechanism to cut the needle thread and the bobbin thread after completion of embroidery sewing operation and thereafter controls the frame moving unit to move the specific type of embroidery frame to the predetermined attachment/detachment position even in case the operation instructing member is not operated.

9. The sewing machine of claim 1, further comprising a position detector that detects a current position of the carriage or the embroidery frame, wherein when attachment of specific type of embroidery frame to the carriage has been detected by the detection mechanism, the validating unit validates operation of the operation instructing member based on a position information of the position detector provided that the specific type of embroidery frame is not in a suitable position for attachment/detachment.

10. A sewing machine capable of embroidery sewing, comprising:

a plurality types of embroidery frames which hold a workpiece cloth;

a carriage that has an embroidery frame of the plurality of types of embroidery frames detachably attached thereto by sliding the embroidery frame in a predetermined direction;

a frame moving unit that moves the carriage in two directions intersecting in a horizontal plane;

a detection mechanism that detects a type of embroidery frame attached to the carriage;

thread cutting mechanism that cuts a needle thread extending from an eye of a sewing needle attached to a lower end of a needle bar and a bobbin thread at a position below a needle plate; and a control unit that controls the thread cutting mechanism to cut the needle thread and the bobbin thread after completion of embroidery sewing operation when attachment of the specific type of embroidery frame to the carriage has been detected by the detection mechanism and thereafter controlling the frame moving unit to move the specific type of embroidery frame to the predetermined attachment/detachment position.

11. The sewing machine of claim 10, further comprising a position detector that detects a current position of the carriage or the embroidery frame, wherein the control unit moves the specific type of embroidery frame to the predetermined attachment/detachment position based on a position information of the position detector when attachment of the specific type of embroidery frame to the carriage has been detected by the detection mechanism provided that the specific type of embroidery frame is not in a suitable position for attachment/detachment.

12. The sewing machine of claim 10, wherein the specific type of embroidery frame is a clamp-type embroidery frame provided with an upper frame and a lower frame vertically clamping a workpiece cloth and a clamp mechanism that presses the upper frame against the lower frame.

13. The sewing machine of claim 12, wherein the predetermined attachment/detachment position is a position allowing the clamp-type embroidery frame to pass through a space between an underside of an embroidery presser foot and a needle plate upper surface when moving the clamp-type embroidery frame in a detaching direction.

14. The sewing machine of claim 13, wherein the predetermined attachment/detachment position is a position where the clamp-type embroidery frame is moved to a front side of a sewing machine body.

* * * * *